US010123622B1

(12) United States Patent
Hall

(10) Patent No.: US 10,123,622 B1
(45) Date of Patent: Nov. 13, 2018

(54) BARBER CHAIR WITH AUXILIARY SEAT

(71) Applicant: Jerome Hall, Concord, NH (US)

(72) Inventor: Jerome Hall, Concord, NH (US)

( * ) Notice: Subject to any disclaimer, the term of this patent is extended or adjusted under 35 U.S.C. 154(b) by 0 days.

(21) Appl. No.: 15/906,182

(22) Filed: Feb. 27, 2018

(51) Int. Cl.
*A47C 1/08* (2006.01)
*A47C 1/06* (2006.01)
*A47C 3/30* (2006.01)

(52) U.S. Cl.
CPC ..... *A47C 1/08* (2013.01); *A47C 1/06* (2013.01); *A47C 3/30* (2013.01)

(58) Field of Classification Search
CPC ..... A47C 1/08; A47C 1/06; A47C 3/30
USPC ..... 297/240
See application file for complete search history.

(56) References Cited

U.S. PATENT DOCUMENTS 2,678,086 A 5/1954 Mohr
2,711,784 A 6/1955 Kuschel
3,223,449 A 12/1965 Naylor
4,863,217 A 9/1989 Fountain
2,252,137 A 9/1994 Kitamura
5,437,495 A 8/1995 Wu
6,851,748 B1 * 2/2005 Garrick ..... A47C 1/03 248/429
2007/0216205 A1 9/2007 Davis

FOREIGN PATENT DOCUMENTS

WO 2016185494 9/2007

* cited by examiner

*Primary Examiner* — Milton Nelson, Jr.

(57) ABSTRACT

The barber chair with auxiliary seat is configured for use with a client hydraulic salon chair. A hair stylist sits on the barber chair with auxiliary seat. The elevation of the barber chair with auxiliary seat is adjustable. The position of the barber chair with auxiliary seat relative to the client hydraulic salon chair is adjustable. The barber chair with auxiliary seat comprises a client hydraulic salon chair, a stylist hydraulic salon chair, a pedestal, a track system, and a control circuit. The client hydraulic salon chair and the stylist hydraulic salon chair mount on the pedestal. The track system attaches the stylist hydraulic salon chair to the pedestal. The control circuit controls the elevation of the stylist hydraulic salon chair. The control circuit controls the position of the stylist hydraulic salon chair relative to the client hydraulic salon chair.

8 Claims, 6 Drawing Sheets

BARBER CHAIR WITH AUXILIARY SEAT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including furniture and chairs adapted for special purposes, more specifically, a hairdressers chair with an auxiliary seat.

SUMMARY OF INVENTION

The barber chair with auxiliary seat is adapted for use with a hair stylist. The barber chair with auxiliary seat is configured for use with a client hydraulic salon chair. The barber chair with auxiliary seat is a seat that is used by the hair stylist while performing hairdressing activities on a client. The elevation of the barber chair with auxiliary seat is adjustable. The position of the barber chair with auxiliary seat relative to the client hydraulic salon chair is adjustable. The barber chair with auxiliary seat comprises a client hydraulic salon chair, a stylist hydraulic salon chair, a pedestal, a track system, and a control circuit. The client hydraulic salon chair and the stylist hydraulic salon chair mount on the pedestal. The track system attaches the stylist hydraulic salon chair to the pedestal. The control circuit controls the elevation of the stylist hydraulic salon chair. The control circuit controls the position of the stylist hydraulic salon chair relative to the client hydraulic salon chair.

These together with additional objects, features and advantages of the barber chair with auxiliary seat will be readily apparent to those of ordinary skill in the art upon reading the following detailed description of the presently preferred, but nonetheless illustrative, embodiments when taken in conjunction with the accompanying drawings.

In this respect, before explaining the current embodiments of the barber chair with auxiliary seat in detail, it is to be understood that the barber chair with auxiliary seat is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the barber chair with auxiliary seat.

It is therefore important that the claims be regarded as including such equivalent construction insofar as they do not depart from the spirit and scope of the barber chair with auxiliary seat. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
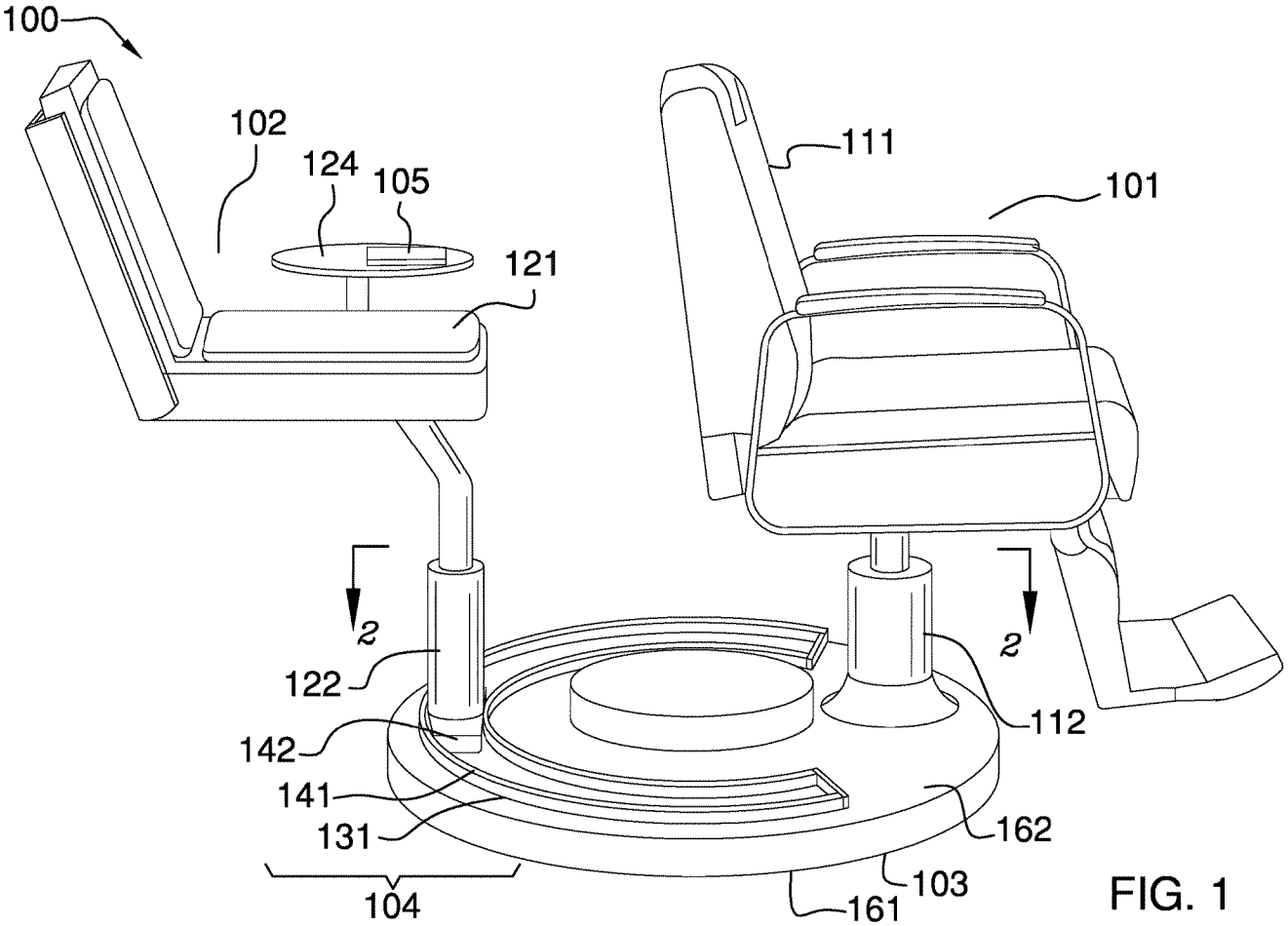
FIG. 1 is a perspective view of an embodiment of the disclosure.
Figure 2:
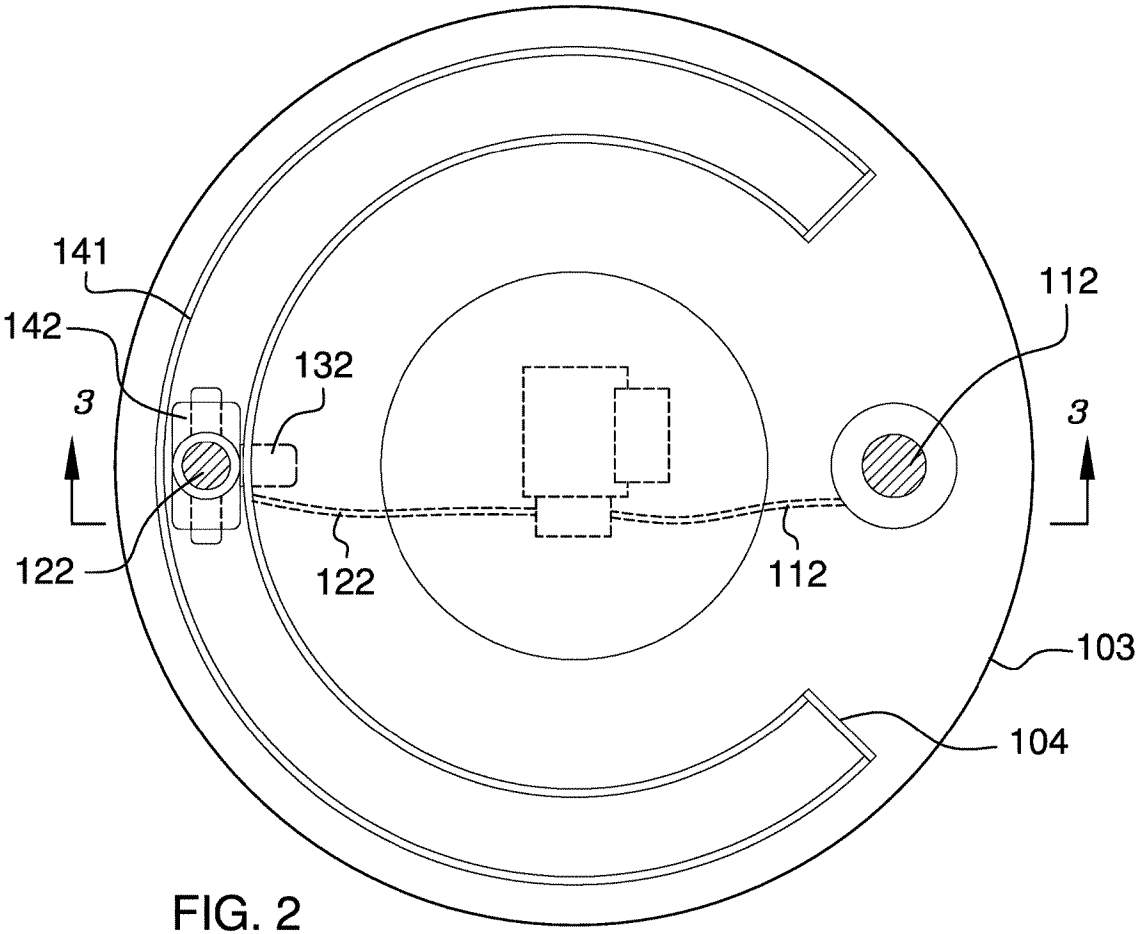
FIG. 2 is a cross-sectional view of an embodiment of the disclosure across 2-2 as shown in FIG. 1.
Figure 3:
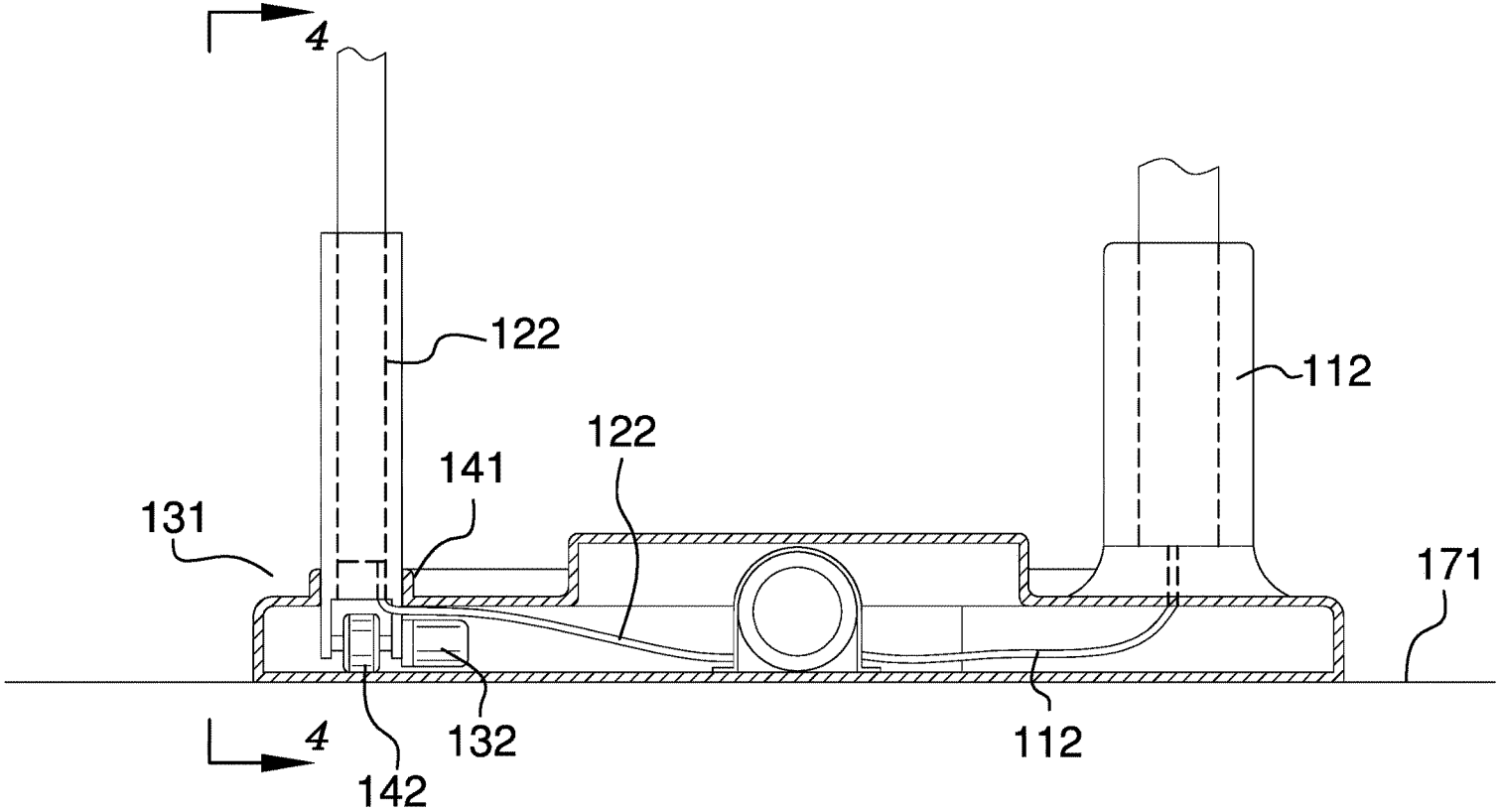
FIG. 3 is a cross-sectional view of an embodiment of the disclosure across 3-3 as shown in FIG. 2.
Figure 4:
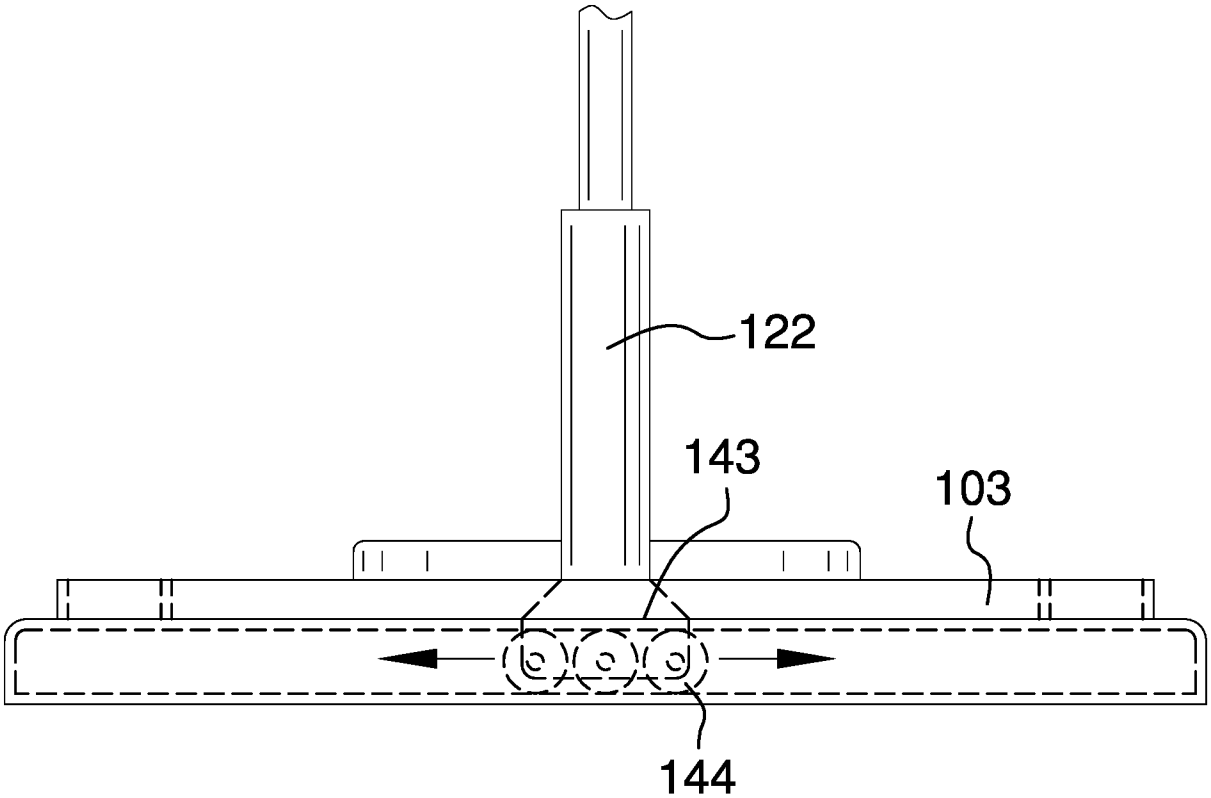
FIG. 4 is a side view of an embodiment of the disclosure.
Figure 5:
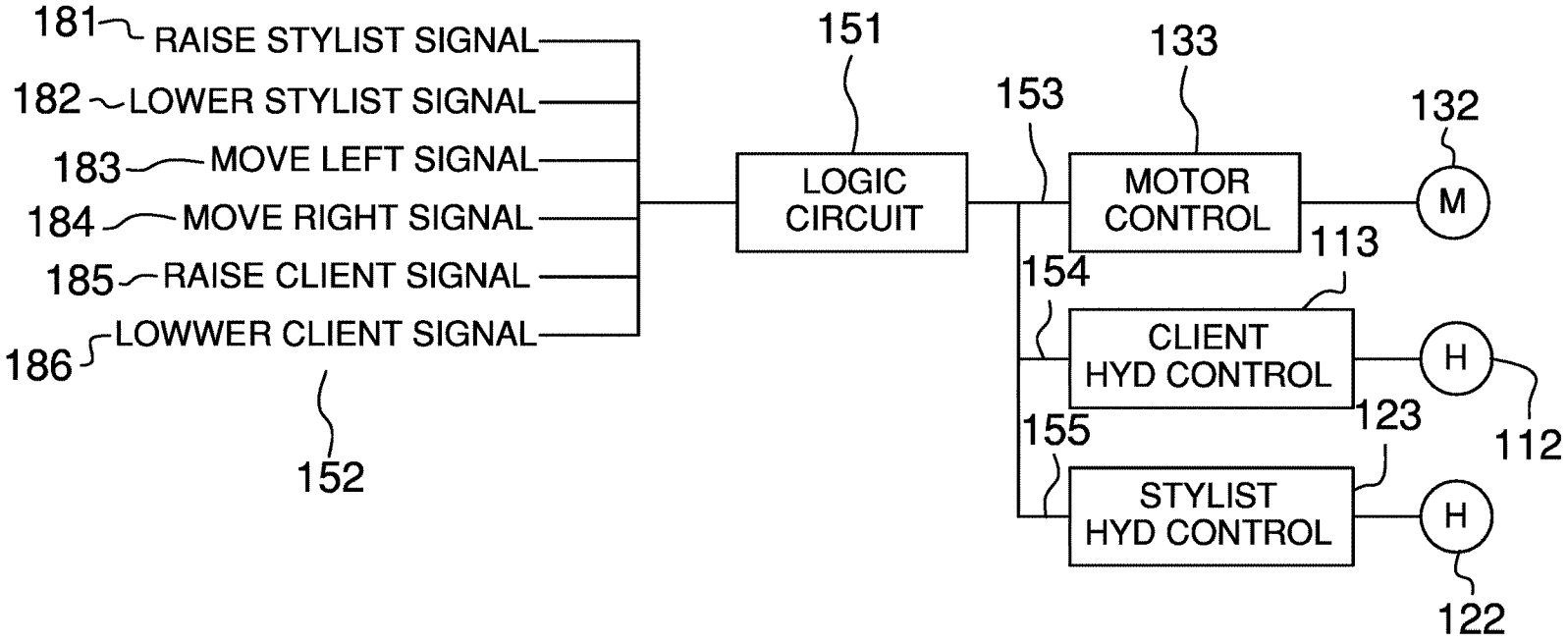
FIG. 5 is a block diagram of an embodiment of the disclosure.
Figure 6:
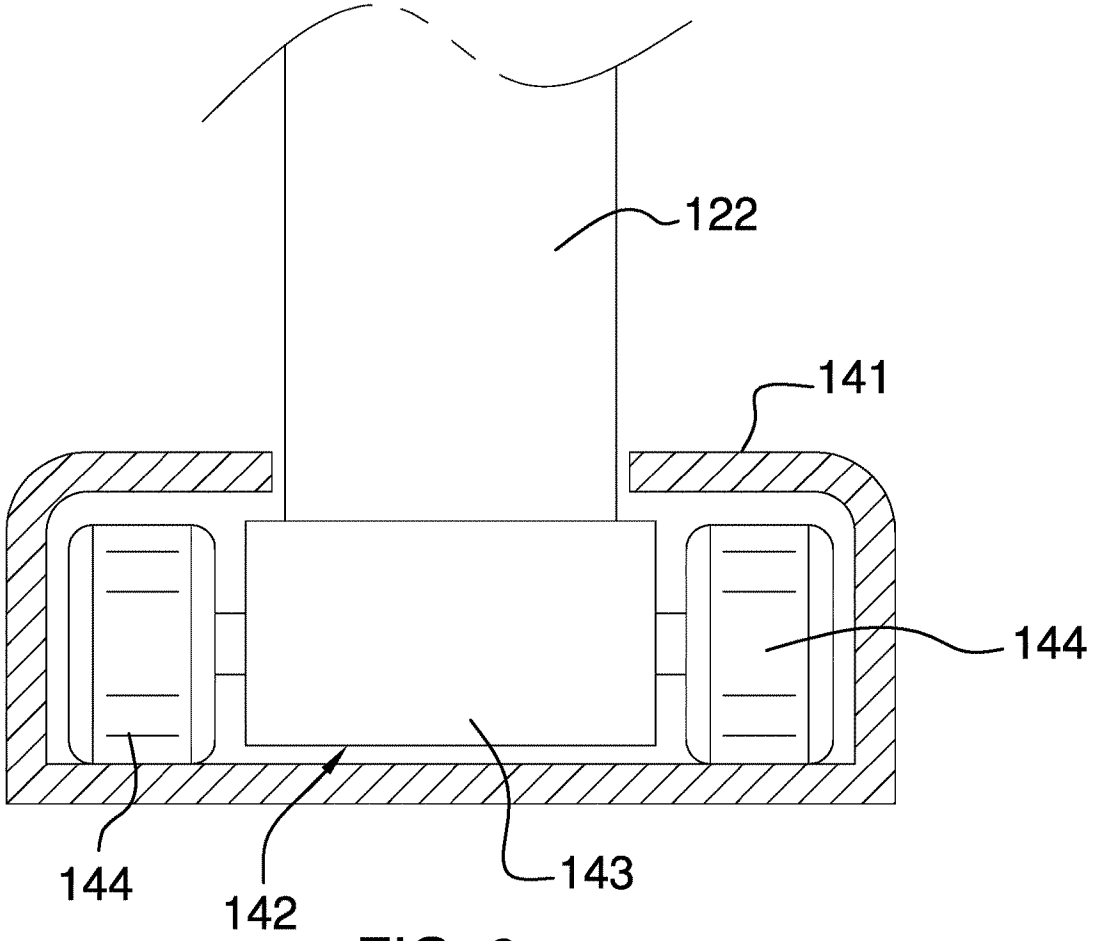
FIG. 6 is a side view of an embodiment of the disclosure.

Detailed reference will now be made to one or more potential embodiments of the disclosure, which are illustrated in FIGS. 1 through 6.

The barber chair with auxiliary seat 100 (hereinafter invention) is adapted for use with a hair stylist. The invention 100 is configured for use with a client hydraulic salon chair 101. The invention 100 is a seat that is used by the hair stylist while performing hairdressing activities on a client. The elevation of the invention 100 is adjustable. The position of the invention 100 relative to the client hydraulic salon chair 101 is adjustable. The invention 100 comprises a client hydraulic salon chair 101, a stylist hydraulic salon chair 102, a pedestal 103, a track system 104, and a control circuit 105. The client hydraulic salon chair 101 and the stylist hydraulic salon chair 102 mount on the pedestal 103. The track system 104 attaches the stylist hydraulic salon chair 102 to the pedestal 103. The control circuit 105 controls the elevation of the stylist hydraulic salon chair 102 relative to the supporting surface 171. The control circuit 105 controls the position of the stylist hydraulic salon chair 102 relative to the client hydraulic salon chair 101.

The client hydraulic salon chair 101 is a commercially available salon chair. The client hydraulic salon chair 101 is hydraulically operated such that the client hydraulic salon chair 101 will raise and lower the elevation of the client relative to the supporting surface 171. The hydraulic operation of the client hydraulic salon chair 101 is powered using an external power source. The client hydraulic salon chair 101 mounts on the superior surface 162 of the pedestal 103. The client hydraulic salon chair 101 has a rotating structure such that a client can rotate when sitting in the client hydraulic salon chair 101. The client hydraulic salon chair 101 comprises a client seat 111, a client hydraulic lift 112, and a client hydraulic lift control 113.

The client seat 111 is the physical seating arrangement presented to the client by the client hydraulic salon chair 101. The client sits in the client seat 111. The client seat 111 rotates relative to the client hydraulic lift 112.

The client hydraulic lift 112 is a hydraulically operated jack. The client seat 111 mounts on the superior end of the client hydraulic lift 112. The client hydraulic lift 112 raises and lowers the client seat 111 to match the desired elevation of the client. The client hydraulic lift 112 is a commercially available hydraulic jack that is powered by an external power source.

The client hydraulic lift control 113 is an electromechanical apparatus. The client hydraulic lift control 113 forms the controlling apparatus that controls the operation of the client hydraulic lift 112. The client hydraulic lift control 113 is used to raise and lower the client seat 111. The client hydraulic lift control 113 is operated using the control circuit 105. The client hydraulic lift control 113 is configured to receive a client hydraulic control signal 154 from the control circuit 105.

The stylist hydraulic salon chair 102 is a commercially available salon chair. The stylist hydraulic salon chair 102 is hydraulically operated such that the stylist hydraulic salon chair 102 will raise and lower the elevation of the hair stylist relative to the supporting surface 171. The hydraulic operation of the stylist hydraulic salon chair 102 is powered using an external power source. The track system 104 attaches the stylist hydraulic salon chair 102 to the superior surface 162 of the pedestal 103 such that the stylist hydraulic salon chair 102 can move in a lateral direction using the stylist hydraulic salon chair 102. The stylist hydraulic salon chair 102 has a rotating structure such that the hair stylist can rotate when sitting in the stylist hydraulic salon chair 102. The stylist hydraulic salon chair 102 comprises a stylist seat 121, a stylist hydraulic lift 122, a stylist hydraulic lift control 123, and a control panel 124.

The stylist seat 121 is the physical seating arrangement presented to the hair stylist by the stylist hydraulic salon chair 102. The hair stylist sits in the stylist seat 121. The stylist seat 121 rotates relative to the stylist hydraulic lift 122.

The stylist hydraulic lift 122 is a hydraulically operated jack. The stylist seat 121 mounts on the superior end of the stylist hydraulic lift 122. The stylist hydraulic lift 122 raises and lowers the stylist seat 121 to match the desired elevation of the hair stylist. The stylist hydraulic lift 122 is a commercially available hydraulic jack that is powered by an external power source.

The stylist hydraulic lift control 123 is an electromechanical apparatus. The stylist hydraulic lift control 123 forms the controlling apparatus that controls the operation of the stylist hydraulic lift 122. The stylist hydraulic lift control 123 is used to raise and lower the stylist seat 121. The stylist hydraulic lift control 123 is operated using the control circuit 105. The stylist hydraulic lift control 123 is configured to receive a stylist hydraulic control signal 155 from the control circuit 105.

The control panel 124 is a housing. The control panel 124 contains the control circuit 105. The control panel 124 is formed with all apertures and form factors necessary to allow the control panel 124 to accommodate the use and operation of the control circuit 105. The control panel 124 mounts on the stylist hydraulic salon chair 102 such that the control panel 124 is accessible by the hair stylist.

The pedestal 103 is a load-bearing structure that transfers the load path of the client hydraulic salon chair 101, the stylist hydraulic salon chair 102, the pedestal 103, and the control circuit 105 to the supporting surface 171. The pedestal 103 is a disk-shaped structure. The pedestal 103 raises the balance of the invention 100 above the supporting surface 171. The pedestal 103 is further defined with an inferior surface 161 and a superior surface 162. The inferior surface 161 is the end of the disk-structure of the pedestal 103 placed on the supporting surface 171. The superior surface 162 is the end of the disk-structure of the pedestal 103 that is distal from the inferior surface 161.

The track system 104 is a mechanical system that: 1) attaches the stylist hydraulic salon chair 102 to the pedestal 103; and, 2) controls the lateral motion of the track system 104 along the superior surface 162 of the pedestal 103. The track system 104 comprises a T track fastener 131, a drive motor 132, and a motor control 133.

The T track fastener 131 is a commercially available track system. The T track fastener 131 controls the lateral movement of the stylist hydraulic salon chair 102. The T track fastener 131 is formed as a segment of the circumference of a circle. In the first potential embodiment of the disclosure, the T track fastener 131 forms an arc of 270 degrees.

The drive motor 132 is an electrical motor. The drive motor 132 provides the motive force necessary to move the stylist hydraulic salon chair 102 along the T track fastener 131. In the first potential embodiment of the disclosure, the drive motor 132 applies the motive force to the wheeled rail 142 in order to move the stylist hydraulic salon chair 102.

The motor control 133 is an electrical circuit that is used to operate the drive motor 132. The motor control 133 and the drive motor 132 are operated by the control circuit 105. The control circuit 105 is configured to receive a motor control signal 153 from the control circuit 105. The first potential embodiment of the disclosure assumes that the motor control 133 is provisioned with the drive motor 132.

The T track fastener 131 comprises a guide channel 141 and a wheeled rail 142. The guide channel 141 forms the channel of the T track fastener 131. The guide channel 141 mounts in a fixed position on the superior surface 162 of the pedestal 103. The guide channel 141 controls the lateral movement of the stylist hydraulic salon chair 102 by controlling the direction of movement of the wheeled rail 142. The wheeled rail 142 is a wheeled structure that inserts into the guide channel 141. The stylist hydraulic salon chair 102 attaches to the wheeled rail 142 such that the movement of the wheeled rail 142 within the guide channel 141 moves the stylist hydraulic salon chair 102 in a lateral direction.

The wheeled rail 142 comprises a mounting block 143 and a plurality of track wheels 144. The mounting block 143 is an inert structure. The stylist hydraulic salon chair 102 attaches to the mounting block 143. The plurality of track wheels 144 attaches to the mounting block 143. The plurality of track wheels 144 attaches to the mounting block 143 such that when the plurality of track wheels 144 are driven by the drive motor 132, the mounting block 143 will move within the guide channel 141 thereby moving the stylist hydraulic salon chair 102 in a lateral direction. The plurality of track wheels 144 comprises a collection wheels that attach to the mounting block 143. The plurality of track wheels 144 roll the mounting block 143 through the guide channel 141.

The control circuit 105 is an electrical circuit. The control circuit 105: 1) controls the lateral movement of the stylist hydraulic salon chair 102 within the track system 104; 2) controls the hydraulic operation of the client hydraulic salon chair 101 to control the elevation of the client in the client hydraulic salon chair 101; and, 3) controls the hydraulic operation of the stylist hydraulic salon chair 102 to control the elevation of the hair stylist in the stylist hydraulic salon chair 102. The control circuit 105 comprises a logic circuit 151, a plurality of control signals 152, a motor control signal 153, a client hydraulic control signal 154, and a stylist hydraulic control signal 155. The logic circuit 151, the plurality of control signals 152, the motor control signal 153, the client hydraulic control signal 154, and the stylist hydraulic control signal 155 are electrically interconnected.

The logic circuit 151 is a non-programmable electrical circuit. The logic circuit 151 monitors the plurality of control signals 152. The logic circuit 151 uses the plurality of control signals 152 as an input source. Based on the input received from the plurality of control signals 152, the logic circuit 151 takes an action selected from the group consisting of: 1) changing the elevation of the client hydraulic salon chair 101; 2) changing the elevation of the stylist hydraulic salon chair 102; and, 3) moving the stylist hydraulic salon chair 102 in a lateral direction.

The logic circuit 151 sends the client hydraulic control signal 154 to the client hydraulic lift control 113 to control the elevation of the client hydraulic salon chair 101. The logic circuit 151 sends the stylist hydraulic control signal 155 to the stylist hydraulic lift control 123 to control the elevation of the stylist hydraulic salon chair 102. The logic circuit 151 sends the motor control signal 153 to the motor control 133 to control the lateral movement of the stylist hydraulic salon chair 102.

The motor control signal 153 is an electrical voltage that is transmitted by the logic circuit 151 to the motor control 133. The motor control 133 uses the motor control signal 153 in a predetermined manner to use the drive motor 132 to move the stylist hydraulic salon chair 102 in a lateral direction.

The client hydraulic control signal 154 is an electrical voltage that is transmitted by the logic circuit 151 to the client hydraulic lift control 113. The client hydraulic lift control 113 uses the motor control signal 153 in a predetermined manner to use the client hydraulic lift 112 to change the elevation of the client hydraulic salon chair 101.

The stylist hydraulic control signal 155 is an electrical voltage that is transmitted by the logic circuit 151 to the stylist hydraulic lift control 123. The stylist hydraulic lift control 123 uses the stylist hydraulic control signal 155 in a predetermined manner to use the stylist hydraulic lift 122 to change the elevation of the stylist hydraulic salon chair 102.

The plurality of control signals 152 comprises a collection of switches that are accessed by the hair stylist. The plurality of control signals 152 are mounted on the control panel 124. Each of the plurality of control signals 152 generates an input signal from the hair stylist to the logic circuit 151. The hair stylist uses the plurality of control signals 152 to indicate the action desired from the control circuit 105. The plurality of control signals 152 comprises a stylist raise signal 181, a stylist lower signal 182, a stylist left signal 183, a stylist right signal 184, a client raise signal 185, and a client lower signal 186.

The stylist raise signal 181 is a momentary switch. The stylist raise signal 181 signals the logic circuit 151 to raise the elevation of the stylist hydraulic salon chair 102 using the stylist hydraulic control signal 155. The stylist lower signal 182 is a momentary switch. The stylist lower signal 182 signals the logic circuit 151 to lower the elevation of the stylist hydraulic salon chair 102 using the stylist hydraulic control signal 155.

The stylist left signal 183 is a momentary switch. The stylist left signal 183 signals the logic circuit 151 to move the stylist hydraulic salon chair 102 to the left using the motor control signal 153. The stylist right signal 184 is a momentary switch. The stylist right signal 184 signals the logic circuit 151 to raise the elevation of the stylist hydraulic salon chair 102 to the right using the motor control signal 153.

The client raise signal 185 is a momentary switch. The client raise signal 185 signals the logic circuit 151 to raise the elevation of the client hydraulic salon chair 101 using the client hydraulic control signal 154. The client lower signal 186 is a momentary switch. The client lower signal 186 signals the logic circuit 151 to lower the elevation of the client hydraulic salon chair 101 using the client hydraulic control signal 154.

The following definitions were used in this disclosure:

Arc: As used in this disclosure, an arc refers to a portion of a circumference or a curved perimeter. When applied to an angle, the arc also refers to a measure of an angular span as measured from a circle at the vertex formed by the sides of the angle.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder, which is defined as a cylinder wherein the curved surface perpendicularly intersects with the two identical flat and parallel ends.

Disk: As used in this disclosure, a disk is a cylindrically shaped object that is flat in appearance.

Electric Motor: In this disclosure, an electric motor is a machine that converts electric energy into rotational mechanical energy.

Elevation: As used in this disclosure, elevation refers to the span of the distance in the superior direction between a specified horizontal surface and a horizontal reference surface.

External Power Source: As used in this disclosure, an external power source is a source of the energy that is externally provided to enable the operation of the present disclosure. Examples of external power sources include, but are not limited to, electrical power sources and compressed air sources.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Housing: As used in this disclosure, a housing is a rigid casing that encloses and protects one or more devices.

Hydraulic: As used in this disclosure, hydraulic refers to a device wherein the movement of the device is powered using a liquid under pressure.

Inert Structure: As used in this disclosure, an inert structure is a physical structure that has no moving parts. An inert structure can be a component of a larger, moving structure.

Inferior: As used in this disclosure, the term inferior refers to a directional reference that is parallel to and in the same direction as the force of gravity.

Jack: As used in this disclosure, a jack is a mechanical device for lifting loads using a force applied with a lever, screw, or hydraulic press.

Lateral: As used in this disclosure, the term lateral refers to motion in a direction that is perpendicular to the direction of the force of gravity.

Load Path: As used in this disclosure, a load path refers to a chain of one or more structures that transfers a load generated by a raised structure or object to a foundation, supporting surface, or the earth.

Logic Circuit: As used in this disclosure, a logic circuit is non-programmable electrical device that receives one or more digital or analog inputs and uses those digital or analog inputs to generate one or more digital or analog outputs.

Momentary Switch: As used in this disclosure, a momentary switch is a biased switch in the sense that the momentary switch has a baseline position that only changes when the momentary switch is actuated (for example when a pushbutton switch is pushed). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Motor: As used in this disclosure, a motor refers to the method of transferring energy from an external power source into rotational mechanical energy.

Motor Controller: As used in this disclosure, a motor controller is an electrical device that is used to control the rotational speed, or simply the speed of the motor, and the direction of rotation of an electric motor. Motor controllers will generally receive one or more inputs, which are used determine the desired rotational speed and direction of rotation of the electric motor.

Pedestal: As used in this disclosure, a pedestal is an intermediary load bearing structure that that transfers a load path between a supporting surface and an object, structure, or load.

Superior: As used in this disclosure, the term superior refers to a directional reference that is parallel to and in the opposite direction of the force of gravity.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

T Track Fastener: As used in this disclosure, a T track fastener is a fastening device that is used to attach a first object to a second object by sliding the first object on to the second object. The T track fastener further comprises a rail and a channel. The rail is attached to the first object and the channel is attached to the second object such that the first object is attached to the second object when the rail is inserted into the channel.

Track: As used in this disclosure, a track is a structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Wheel: As used in this disclosure, a wheel is a circular object that revolves around an axle or an axis and is fixed below an object to enable it to move easily over the ground.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An auxiliary seat for a barber chair comprising:

a client hydraulic salon chair, a stylist hydraulic salon chair, a pedestal, a track system, and a control circuit;

wherein the client hydraulic salon chair and the stylist hydraulic salon chair mount on the pedestal;

wherein the track system attaches the stylist hydraulic salon chair to the pedestal;

wherein the control circuit controls the elevation of the client hydraulic salon chair relative to a supporting surface;

wherein the control circuit controls the elevation of the stylist hydraulic salon chair relative to the supporting surface;

wherein the control circuit controls the position of the stylist hydraulic salon chair relative to the client hydraulic salon chair;

wherein the client hydraulic salon chair is a salon chair;

wherein the client hydraulic salon chair is hydraulically operated;

wherein the hydraulic operation of the client hydraulic salon chair is powered using an external power source;

wherein the client hydraulic salon chair mounts on a superior surface of the pedestal;

wherein the client hydraulic salon chair has a rotating structure;

wherein the stylist hydraulic salon chair is a commercially available salon chair;

wherein the stylist hydraulic salon chair is hydraulically operated;

wherein the hydraulic operation of the stylist hydraulic salon chair is powered using an external power source;

wherein the track system attaches the stylist hydraulic salon chair to the superior surface of the pedestal such that the stylist hydraulic salon chair can move in a lateral direction using the track system;

wherein the stylist hydraulic salon chair has a rotating structure;

wherein the pedestal is a load-bearing structure;

wherein the pedestal transfers a load path of the client hydraulic salon chair, the stylist hydraulic salon chair, the pedestal, and the control circuit to the supporting surface;

wherein the pedestal raises the client hydraulic salon chair, the stylist hydraulic salon chair, and the control circuit above the supporting surface;

wherein the track system is a mechanical system;

wherein the track system drives a lateral motion of the track system along the superior surface of the pedestal;

wherein the control circuit is an electrical circuit;

wherein the control circuit controls the lateral movement of the stylist hydraulic salon chair within the track system;

wherein the control circuit controls the hydraulic operation of the client hydraulic salon chair to control the elevation of the client in the client hydraulic salon chair;

wherein the control circuit controls the hydraulic operation of the stylist hydraulic salon chair to control the elevation of the hair stylist in the stylist hydraulic salon chair;

wherein the client hydraulic salon chair comprises a client seat, a client hydraulic lift, and a client hydraulic lift control;

wherein the client seat mounts on a superior end of the client hydraulic lift;

wherein the client hydraulic lift is a hydraulically operated jack;

wherein the client seat rotates relative to the client hydraulic lift;

wherein the client hydraulic lift raises and lowers the client seat;

wherein the client hydraulic lift is powered by an external power source;

wherein the client hydraulic lift control is an electromechanical apparatus;

wherein the client hydraulic lift control controls the operation of the client hydraulic lift;

wherein the client hydraulic lift control is operated using the control circuit;

wherein the stylist hydraulic salon chair comprises a stylist seat, a stylist hydraulic lift, and a stylist hydraulic lift control;

wherein the stylist seat mounts on a superior end of the stylist hydraulic lift;

wherein the stylist hydraulic lift is a hydraulically operated jack;

wherein the stylist seat rotates relative to the stylist hydraulic lift;

wherein the stylist hydraulic lift raises and lowers the stylist seat;

wherein the stylist hydraulic lift is powered by an external power source;

wherein the stylist hydraulic lift control is an electromechanical apparatus;

wherein the stylist hydraulic lift control controls the operation of the stylist hydraulic lift;

wherein the stylist hydraulic lift control is operated using the control circuit;

wherein the stylist hydraulic salon chair comprises a control panel;

wherein the control panel is a housing;

wherein the control panel contains the control circuit;

wherein the control panel mounts on the stylist hydraulic salon chair such that the control panel is accessible;

wherein the pedestal is a disk-shaped structure;

wherein the track system comprises a T track fastener, a drive motor, and a motor control;

wherein the T track fastener guides the lateral movement of the stylist hydraulic salon chair;

wherein the drive motor is an electrical motor;

wherein the drive motor provides the motive force necessary to move the stylist hydraulic salon chair along the T track fastener;

wherein the motor control is an electrical circuit used to operate the drive motor.

2. The auxiliary seat for a barber chair according to claim 1 wherein the motor control and the drive motor are operated by the control circuit.

3. The auxiliary seat for a barber chair according to claim 2 wherein the T track fastener is formed as a segment of the circumference of a circle;

wherein the T track fastener forms an arc of 270 degrees.

4. The auxiliary seat for a barber chair according to claim 3 wherein the T track fastener comprises a guide channel and a wheeled rail;

wherein the guide channel forms the channel of the T track fastener;

wherein the guide channel mounts in a fixed position on the superior surface of the pedestal;

wherein the guide channel controls the lateral movement of the stylist hydraulic salon chair by controlling the direction of movement of the wheeled rail;

wherein the wheeled rail is a wheeled structure that inserts into the guide channel;

wherein the stylist hydraulic salon chair attaches to the wheeled rail such that the movement of the wheeled rail within the guide channel moves the stylist hydraulic salon chair in a lateral direction.

5. The auxiliary seat for a barber chair according to claim 4 wherein the wheeled rail comprises a mounting block and a plurality of track wheels;

wherein the mounting block is an inert structure;

wherein the stylist hydraulic salon chair attaches to the mounting block;

wherein the plurality of track wheels attaches to the mounting block;

wherein the plurality of track wheels attaches to the mounting block such that when the plurality of track wheels are driven by the drive motor, the mounting block will move within the guide channel thereby moving the stylist hydraulic salon chair in a lateral direction.

6. The auxiliary seat for a barber chair according to claim 5 wherein the control circuit comprises a logic circuit, a plurality of control signals, a motor control signal, a client hydraulic control signal, and a stylist hydraulic control signal;

wherein the logic circuit, the plurality of control signals, the motor control signal, the client hydraulic control signal, and the stylist hydraulic control signal are electrically interconnected;

wherein the logic circuit is a non-programmable electrical circuit;

wherein the logic circuit monitors the plurality of control signals;

wherein the logic circuit takes an action selected from the group consisting of: a) changing the elevation of the client hydraulic salon chair; b) changing the elevation of the stylist hydraulic salon chair; and, c) moving the stylist hydraulic salon chair in a lateral direction.

7. The auxiliary seat for a barber chair according to claim 6 wherein the logic circuit sends the client hydraulic control signal to the client hydraulic lift control to control the elevation of the client hydraulic salon chair;

wherein the client hydraulic control signal is an electrical voltage that is transmitted by the logic circuit to the client hydraulic lift control;

wherein the client hydraulic lift control uses the motor control signal in a predetermined manner to use the client hydraulic lift to change the elevation of the client hydraulic salon chair;

wherein the logic circuit sends the stylist hydraulic control signal to the stylist hydraulic lift control to control the elevation of the stylist hydraulic salon chair;

wherein the stylist hydraulic control signal is an electrical voltage that is transmitted by the logic circuit to the stylist hydraulic lift control;

wherein the stylist hydraulic lift control uses the stylist hydraulic control signal in a predetermined manner to use the stylist hydraulic lift to change the elevation of the stylist hydraulic salon chair;

wherein the logic circuit sends the motor control signal to the motor control to control the lateral movement of the stylist hydraulic salon chair;

wherein the motor control signal is an electrical voltage that is transmitted by the logic circuit to the motor control;

wherein the motor control uses the motor control signal in a predetermined manner to use the drive motor to move the stylist hydraulic salon chair in a lateral direction.

8. The auxiliary seat for a barber chair according to claim 7 wherein the plurality of control signals are mounted on the control panel;

wherein each of the plurality of control signals generates an input signal from the hair stylist to the logic circuit;

wherein the plurality of control signals comprises a stylist raise signal, a stylist lower signal, a stylist left signal, a stylist right signal, a client raise signal, and a client lower signal;

wherein the stylist raise signal is a momentary switch;

wherein the stylist raise signal signals the logic circuit to raise the elevation of the stylist hydraulic salon chair using the stylist hydraulic control signal;

wherein the stylist lower signal is a momentary switch;

wherein the stylist lower signal signals the logic circuit to lower the elevation of the stylist hydraulic salon chair using the stylist hydraulic control signal;

wherein the stylist left signal is a momentary switch;

wherein the stylist left signal signals the logic circuit to move the stylist hydraulic salon chair to the left using the motor control signal;

wherein the stylist right signal is a momentary switch;

wherein the stylist right signal signals the logic circuit to raise the elevation of the stylist hydraulic salon chair to the right using the motor control signal;

wherein the client raise signal is a momentary switch;

wherein the client raise signal signals the logic circuit to raise the elevation of the client hydraulic salon chair using the client hydraulic control signal;

wherein the client lower signal is a momentary switch;

wherein the client lower signal signals the logic circuit to lower the elevation of the client hydraulic salon chair using the client hydraulic control signal.

* * * * *